United States Patent [19]

Scripter

[11] Patent Number: 4,962,956

[45] Date of Patent: Oct. 16, 1990

[54] WASTE COLLECTION DEVICE

[76] Inventor: Robert D. Scripter, 3702 E. Miami, Phoenix, Ariz. 85040

[21] Appl. No.: 473,930

[22] Filed: Feb. 2, 1990

[51] Int. Cl.[5] ..... A01K 29/00; E01H 1/12

[52] U.S. Cl. ..... 294/1.4; 15/257.4; 248/99; 294/55

[58] Field of Search ..... 294/1.1, 1.3–1.5, 294/19.1, 55; 15/104.8, 257.1, 257.4, 257.7; 56/400.04, 400.11; 141/108, 109, 390; 248/95, 97, 99–101; 383/33

[56] References Cited

U.S. PATENT DOCUMENTS

| | | | |
|---|---|---|---|
| 1,265,996 | 5/1918 | Cerny | 294/1.1 X |
| 4,012,067 | 3/1977 | Travis | 294/1.4 |
| 4,191,414 | 3/1980 | Dameron | 294/1.4 |
| 4,428,610 | 1/1984 | Guffey | 294/1.3 |
| 4,500,125 | 2/1985 | Olson | 294/1.4 |
| 4,705,310 | 11/1987 | Scripter | 294/1.4 |
| 4,875,729 | 10/1989 | Peck | 294/1.3 |

*Primary Examiner*—Johnny D. Cherry
*Attorney, Agent, or Firm*—Gregory J. Nelson

[57] ABSTRACT

A waste collection device for animal waste having an elongate tubular handle and a head defining a frame at the lower end. The frame is fabricated from a resilient material such as spring wire and removably supports a plastic bag which bag is disposed of when the collection procedure is completed. A retention slot is provided in a portion of the handle so that a cuff on the bag may be engaged with a portion of the frame and a portion of the bag pinched and frictionally engaged in the slot to temporarily secure the bag in place.

4 Claims, 1 Drawing Sheet

WASTE COLLECTION DEVICE

The present invention relates to a waste collection device and more particularly to a device for the sanitary collection and disposal of animal waste within a disposable receptacle.

The waste or refuse left by domestic animals and pets is unsightly and more importantly often presents a health hazard. Accordingly, many cities and towns have passed strict ordinances which require pet owners to collect and properly dispose of such refuse and failure to do so can result in substantial fines. Various types of sanitary disposal devices have been developed in an attempt to provide an efficient and convenient implement for this purpose which permits the pet owner to collect the refuse without directly coming in touch with the refuse and further to permit sanitary disposal of the waste.

U.S. Pat. No. 3,659,891 shows a refuse collecting device having a tubular bag mounting member at the lower end of the handle for collecting refuse. The refuse is collectable in a disposable bag removably mounted on a tubular element by a retention collar.

U S. Pat. No. 4,021,994 shows a device for removing animal droppings which device has a folding handle secured to a rim to support the open edge portion of a disposable bag. The bag is held in place by a hinged bag clamp. The bag has a lip portion which extends outwardly and away from the bag to allow users to scoop material into the bag.

A somewhat similar device for the collection of canine waste is shown in U. S. Pat. No. 4,221,415. The apparatus shown in this patent has pivotally connected first and second frame elements which retain a disposable sanitation sheet such as a paper towel in position. The first frame member is rotationally displaceable with respect to the second member for enveloping waste contents within the sheet. An elongate handle is attached to the second frame member for manipulating the apparatus.

U. S. Pat. No. 3,575,737 shows a device for picking up animal droppings which includes a frame for holding a bag in an open position near the lower end of the handle. A removable paddle is arranged to propel the waste into the bag. Movement of the paddle is remotely controlled at the upper end of the handle.

U.S. Pat. No. 4,500,125 shows a pet waste collecting device with a handle having a frame at one end to support a plastic bag. The bag is secured at a hook at the junction of the frame and handle. A scoop fits telescopically and detachably within the tube.

My prior patent, U. S. Pat. No. 4,705,310, shows a waste collection device for animal waste having an elongate tubular handle with a flexible frame at the lower end. The frame supports a removable plastic bag which bag is disposable when collection procedures are completed. A clip permits various sized plastic merchandise bags to be retained on the frame. The frame may be used separately as a short hand-held scoop device independent of the tubular handle.

Devices such as those described above render the task of collection of animal waste less offensive and more convenient. Devices such as those with movable paddles or scoops however are often cumbersome and difficult to use. Devices which use throw-away receptacles, such as plastic bags often do not provide convenient ways of attaching the bag. These devices are difficult for the user to secure and detach the bag and accordingly require the user to come into contact with the waste or a portion of the device which has been in contact with the animal waste.

The present invention represents a further improvement in the state of such waste collection devices. It is an object of the present invention to provide an efficient, light-weight waste or refuse collection device which detachably supports plastic receptacles such as polymeric bags of various sizes and shapes for the collection and disposal of waste. The present invention permits the user to easily, quickly and conveniently secure bags of various sizes and shapes to the collection head or frame. This allows the user to utilize merchandise bags of various sizes and shapes which may be collected or saved by the user and later, in turn, used in conjunction with the invention resulting in convenience and savings to the user since no special type of bag is needed.

Briefly, in accordance with the present invention, the waste collection device includes an elongate tubular handle having a frame disposed at the lower end of the handle. In the preferred embodiment, the frame is generally triangular in shape having an extension at the frame at its upper end which is inserted into the lower end of the tubular handle. The lower end of the handle is flattened about the frame insert to secure the frame in place and to form a bag-mounting plate which defines an upwardly opening retention channel or slot. A part of a flexible merchandise bag may be pulled through the frame with the edge of the bag formed as a cuff engaging the frame. An upper edge of the cuff is pulled through the retention opening in the frame and when the bag is in a taut position on the frame, the edge of the bag may then be pulled downwardly and frictionally engaged in the retention slot or channel. When it is desired to dispose of the bag and the contents, the bag may be easily removed from the frame by unlocking the edge portion of the bag from the retention slot. Preferably the frame is a flexible material such as spring steel wire.

The above and other objects and advantages of the present invention will be more fully understood from a consideration of the following description, claims and accompanying drawings in which a preferred adaptation of the invention has been illustrated with the various elements identified by appropriate reference characters in each of the views in which:

Turning now to the drawings, the pet waste collection device of the present invention is generally indicated by the numeral 10 and includes an elongate tubular handle 12 having a generally triangular shaped head or frame member 14 secured at the lower end of the handle 12. The upper end of the handle is provided with a grip 15 of rubber or plastic for the comfort of the user and has finger recesses to provide a better grasp of the device for manipulation. The tubular handle may be constructed from any suitable material but is preferably formed of one inch diameter heavy wall aluminum tubing.

Figure 2:
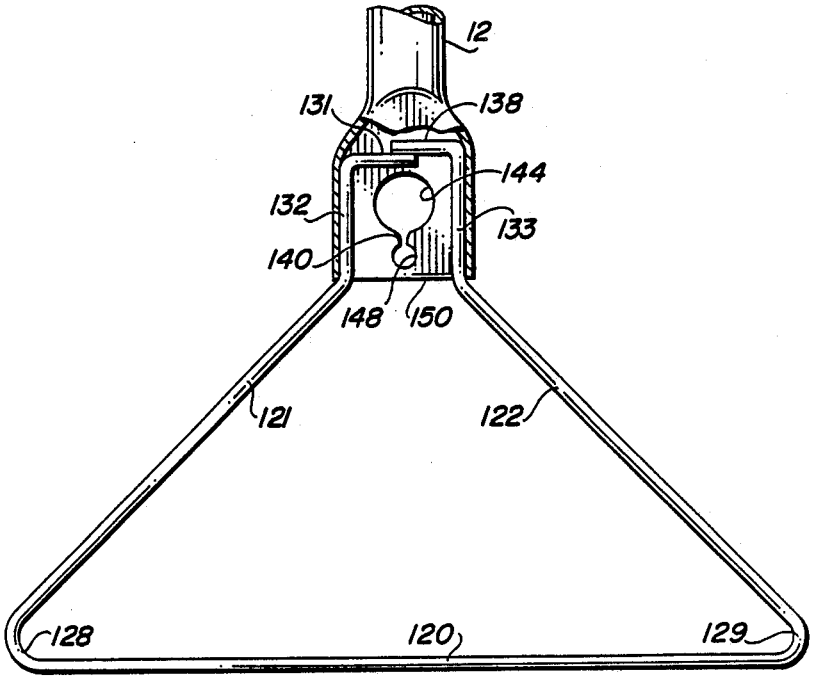
FIG. 2 is a front view of the frame of the device with a portion of the handle broken away.
Figure 3:
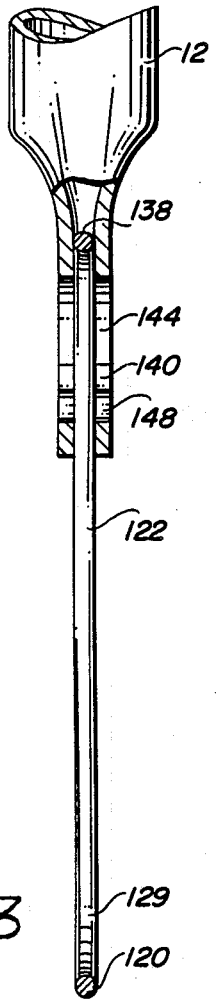
FIG. 3 is a side view of the frame and lower end of the handle.

The frame or head 14, as best seen in FIGS. 2 and 3, is generally triangular having a generally horizontal base 120 and oppositely, upwardly converging sides 121 and 122. The upper ends of sides 121 and 122 are formed having parallel extensions 132 and 133 which are joined at their upper end by a bight section comprising overlapping members 131 and 138. The frame is preferably formed from a single piece of wire such as a spring wire having slight flexibility with the ends overlapping in the bight section so the upper extensions 132 and 133 may be inserted into the lower end of the handle. The bight allows the extensions to be squeezed together to permit the extensions to be inserted into the lower, distal end of the handle. When inserted, the lower end of the handle is flattened capturing the extensions 132 and 133 of the frame and forming a flat plate-like section 150 therebetween.

Plate 150 extends between the extensions of the frame having a generally clithridate or keyhole-shaped aperture 140 having an enlarged opening 144 at the upper end and a lower slot or channel 148 axially extending from the opening 144 which may be stamped in the same operation as the flattening of the lower end of the handle. The large upper opening 144 may typically be approximately one inch or so in width with the lower slot being typically 174 " in width. As will be explained hereafter, the retention aperture 140 permits insertion and securement of a collection bag such as a plastic merchandise bag to the frame.

The device of the present invention is designed to be used with receptacles such as conventional plastic merchandise bags of various sizes and shapes. Accordingly, the user may collect bags from supermarkets and department stores and re-use these bags with the present device resulting in substantial savings and convenience to the user. Similarly, small waste disposal and sandwich bags may also be used. The user is provided with the advantage that no special bag need be purchased for use with the device.

Figure 1:
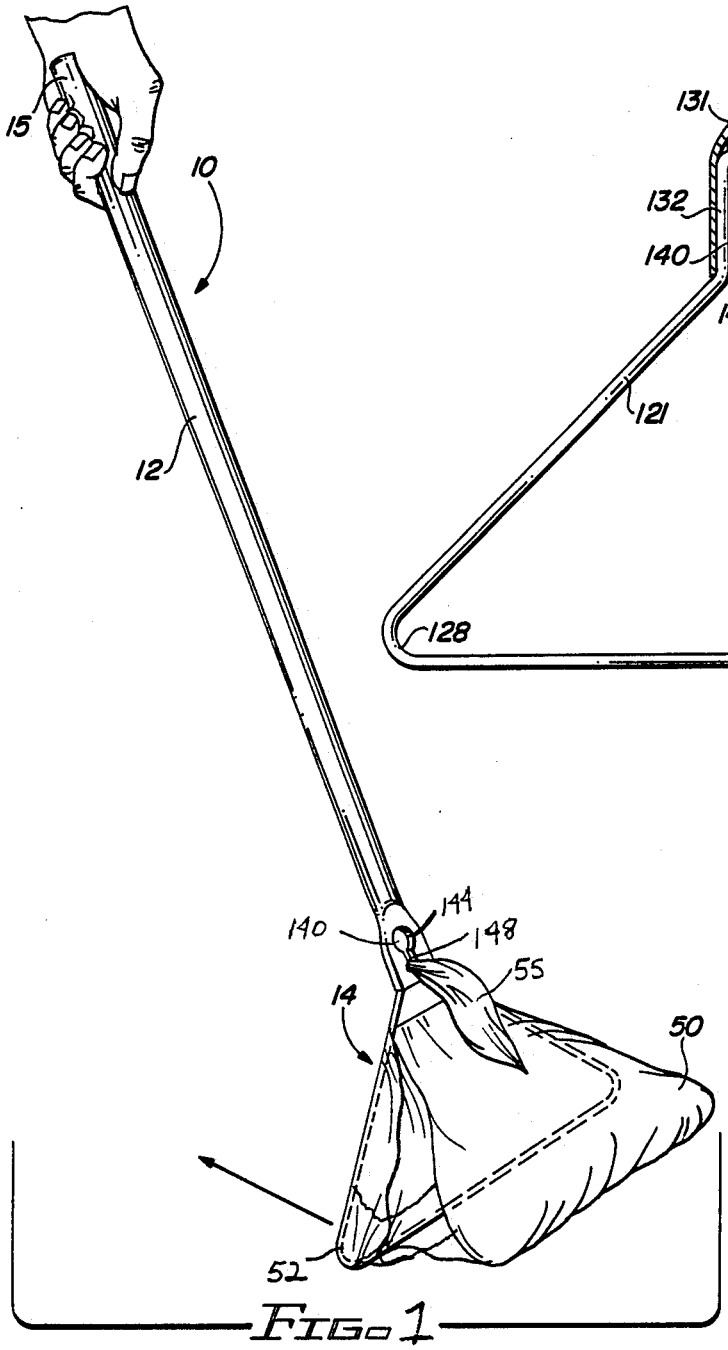
FIG. 1 is a perspective view of the waste collection device of the present invention showing a collection receptacle attached to the frame of the device.

A suitable bag 50 is partially inserted in the frame from one side of the frame which for purposes of reference will be designated as the front side. It will be obvious that the device is reversible and either edge of the frame may be considered the front. The bag is partially inserted into the frame as shown in FIG. 1 with the bag extending through the rear of the frame. An edge of the bag is reversely folded into a cuff 52 which is engaged at the lower corners of the frame and along the lower member 120. The bag is then pulled rearwardly until the inner portion of the cuff tautly engages at least the lower corners and the member 120.

A portion 55 of the bag adjacent the locking plate is pinched or bunched and pulled rearwardly through the larger opening 144 in the plate. This will cause the portion of the bag engaging the frame to draw even more snugly about the frame to secure the bag in place. The pinched portion 55 of the bag may then be secured by pulling the pinched portion 55 axially downwardly to compress the bag and to frictionally engage the bag within the lower axial channel 148.

With the bag secured in place as shown in FIG. 1, the operation and use of the device is convenient for the user. The elongate, tubular handle allows the user to collect refuse in a standing position with a minimum of bending or stooping. The frame configuration allows waste to be easily directed into the plastic receptacle by the user drawing the frame toward the user in a scraping or scooping action. The flexible or spring nature of the frame assists in the collection procedure as with minimal practice the spring of the frame will advance the bag around waste or refuse.

When used in this manner, the material collected is contained within the bag and may be conveniently disposed of in a sanitary manner. The frame is protected from contact with the waste material by the cuff on the bag so that the user does not come into contact with any portion of the device that may be rendered unsanitary by contact with waste material. To dispose of the receptacle, the user simply draws the pinched portion of the bag axially upward along the slot 148 releasing the bag so that it may be disengaged from the frame.

It will be seen from the foregoing that the present invention provides an animal waste collection apparatus which achieves the various objects of the present invention and which device is convenient and efficient to use. It will be obvious to those skilled in the art to make various changes, alterations and modifications to the device described herein. To the extent these various alterations, modifications and changes do not depart from the spirit and scope of the appended claims, they are intended to be encompassed therein.

I claim:

1. A waste collection device for use with a disposable, flexible merchandise bag of the type having an opening defined by an edge, said device comprising:

(a) an elongate generally axially extending handle having an upper and lower end, said lower end defining a recess having a wall;

(b) a flexible frame having a base and opposite sides which sides terminate at parallel projections, said projections engaged in said recess with said wall being at least partially flattened to engage and secure said frame projections therein;

(c) said wall defining bag retaining means, said bag retaining means comprising a first large aperture connected to a smaller aperture, whereby an edge of said bag may be engaged to at least a part of said frame with the bag positioned in said frame whereby a portion of the edge of the bag can be passed through said bag retaining means and frictionally engaged therein for temporarily securing said bag to said frame.

2. The device of claim 1 wherein said projections include overlapping members extending inwardly toward the axial center line of said handle.

3. The device of claim 1 wherein said frame is formed from spring steel.

4. The device of claim 1 wherein said handle is tubular.

* * * * *